US005787501A

United States Patent [19]

Coleman

[11] Patent Number: 5,787,501

[45] Date of Patent: Aug. 4, 1998

[54] HAND AND WRIST PROTECTOR FOR IN-LINE SKATING

[75] Inventor: W. Carl Coleman, Seattle, Wash.

[73] Assignee: Trace Athletic Corporation, Seattle, Wash.

[21] Appl. No.: 822,931

[22] Filed: Mar. 21, 1997

[51] Int. Cl.[6] ..... A41D 13/08

[52] U.S. Cl. ..... 2/16; 2/161.1

[58] Field of Search ..... 2/16, 21, 910, 2/162, 159, 161.1, 161.3, 161.4, 170

[56] References Cited

U.S. PATENT DOCUMENTS 4,531,241 7/1985 Berger ..... 2/162 X
5,435,007 7/1995 Kalvestran et al. ..... 2/162 X
5,526,531 6/1996 Olson et al. ..... 2/162 X

*Primary Examiner*—Michael A. Neas

[57] ABSTRACT

The protective hand and wrist guard includes a front portion which is substantially rigid. The front portion includes a first section which extends over the inner wrist area of the user. A second section extends therefrom and curves over the heel area of the hand and into the palm area, extending upwardly to an upper end which extends across the hand just below the base of the fingers. One side edge curves partially around a lower edge of the hand, while an opposing edge curves below the base of the thumb and includes an outwardly extending portion which at its free end curves partially around an upper edge of the hand between the forefinger and the thumb. A protective pad is attached to the inner surface of the front portion, while straps at the upper and lower ends secure the article firmly on the user.

4 Claims, 3 Drawing Sheets

HAND AND WRIST PROTECTOR FOR IN-LINE SKATING

TECHNICAL FIELD

This invention relates generally to protective equipment for games and sports, and more particularly concerns a hand and wrist protector which is particularly suitable for use for in-line skating.

BACKGROUND OF THE INVENTION

Various games and sports have hand and/or wrist protectors and gloves of various kinds and configurations, including for instance, soccer, football and baseball, among others, because of the potential for injury to that area of the body. In-line skating, in which the user wears boots which have a single row of wheels on the lower surface thereof, is a relatively new sport which can involve fairly high speeds and also has a potential for injury. Accordingly, an in-line skater typically uses a substantial amount of bodily protection, including knee pads, elbow pads and wrist protectors, as well as a helmet.

Hand and wrist protectors have been an important area of protection for inline skaters, since the hand and wrist are particularly vulnerable in falls, which can easily occur during in-line skating. The relatively high speeds which are possible with in-line skates, as well as the hard and abrasive surfaces on which in-line skates are used, increase the likelihood and severity of hand and wrist injuries.

Originally, hand and wrist protectors were single-piece items which fitted over part of the hand and the wrist. They included a brace portion to prevent or reduce a rearward hyperextension of the wrist. However, these protectors had several disadvantages. They had poor air ventilation and they were awkward to put on, because of the use of several different straps. The brace members were quite narrow and the protection was primarily only rearward.

A two-piece protector, such as shown in FIG. 1, was then developed which includes front and back stiff sections 11, 13, which are positioned adjacent the front and back of the hand, joined by stretchable mesh fabric 15, with straps 17, 19 at the upper and lower ends thereof, to hold the unit on the hand/wrist of the user. The front and back sections of the two-piece protector are both fairly rigid, but still will bend or twist with a relatively small amount of force. This protector also has the disadvantage of a lack of air ventilation at the back of the hand and in the wrist area. The front-back brace arrangement encumbers the hand and wrist. The bracing members are wider than the single piece unit and there are straps just at the front and rear of the protector. The front section does have some bracing effect. However, the protector is still difficult to get on and off, and is not particularly comfortable when it is on. The user also cannot close his hand fully, because of the design, and portions of the hand still remain unprotected.

DISCLOSURE OF THE INVENTION

Accordingly, the invention is a protective member for the hand and wrist area of a user, comprising: a front portion which extends from a point in the vicinity of the wrist area of the user to an upper palm area of the hand, the front portion contouring over a heel portion of the hand and into the palm area, terminating in an upper end which extends across the palm, slightly below the fingers, the front portion including a first edge part which curves partially about a portion of an upper edge of the hand between the thumb and forefinger, and further including an opposite edge part which curves partially about an opposing edge of the hand; a portion of resilient material which is attached to an inner surface of the front portion such that it is adjacent the hand and wrist of the user when the protective member is in place on the user's hand; and a pair of straps, one at an upper end and the other at an opposing lower end of the front portion, for holding the protective member in place on the hand and wrist of the user.

BEST MODE FOR CARRYING OUT THE INVENTION

Figure 1:
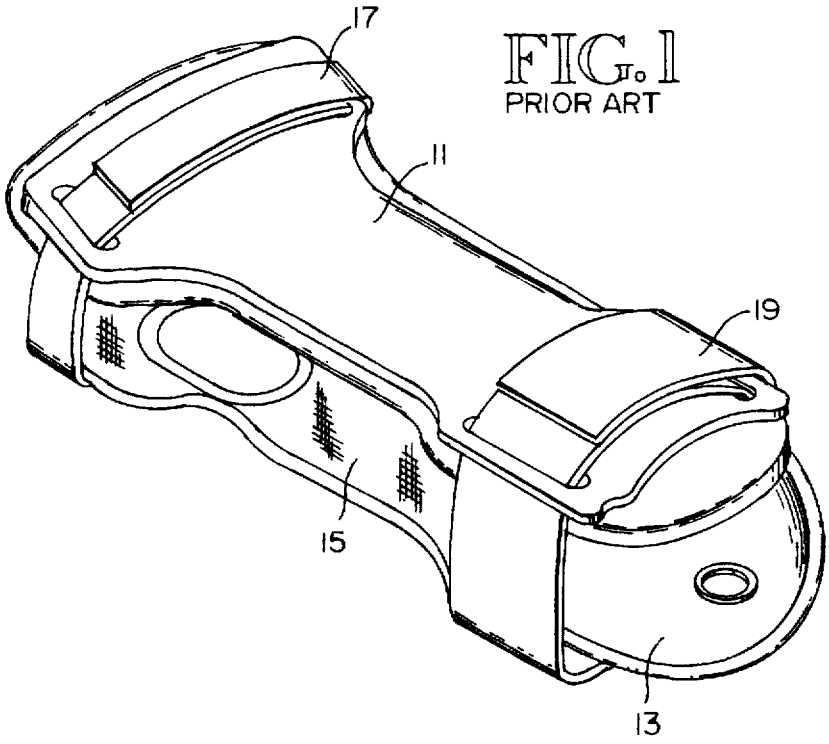
FIG. 1 PRIOR ART
FIG. 1 is a perspective view of a right hand version of a prior art hand protector.
Figure 2:
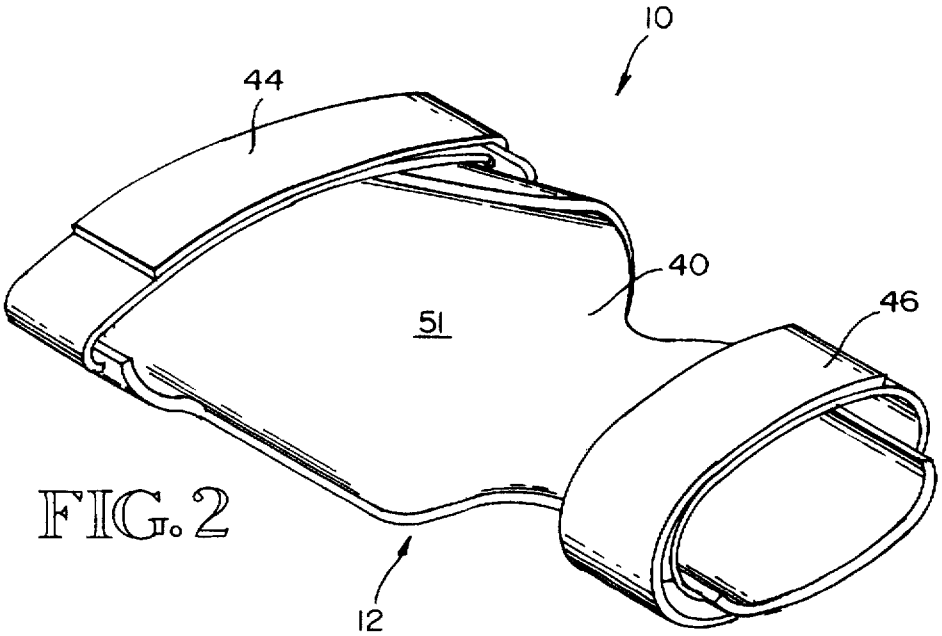
FIG. 2 is a perspective view (from the top) of the hand and wrist protector of the present invention.
Figure 3:
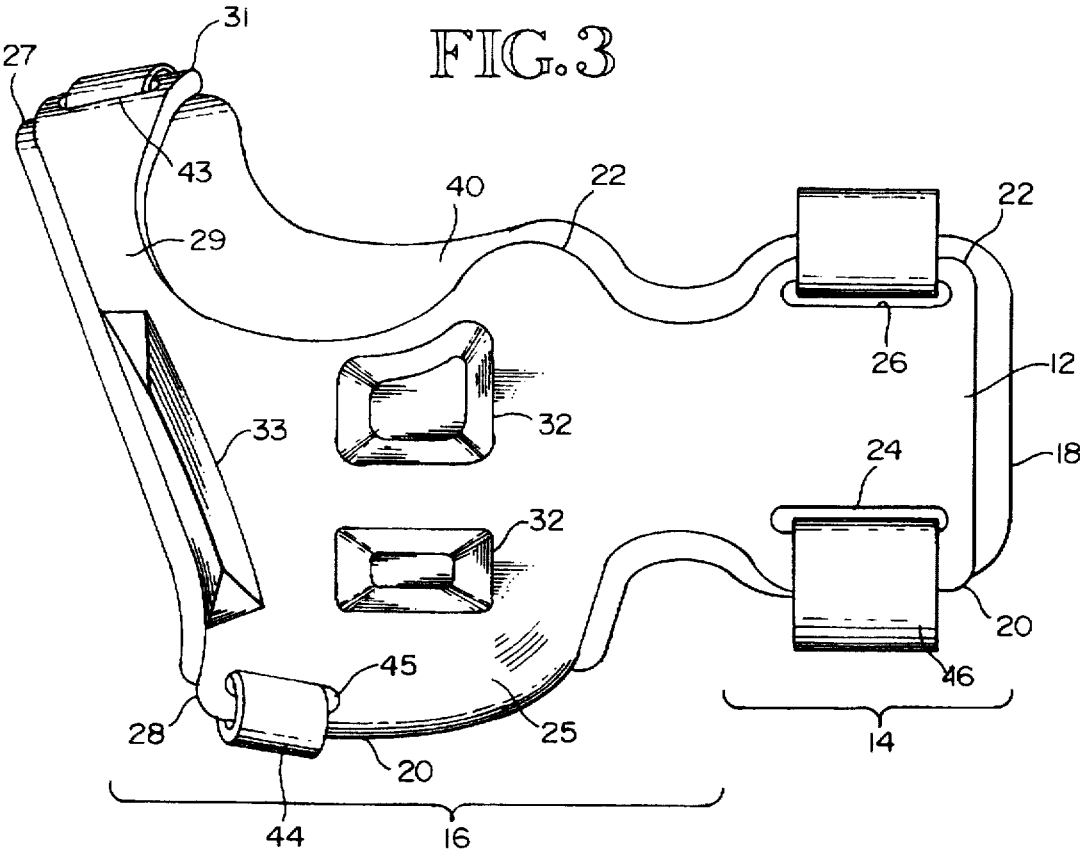
FIG. 3 is a bottom view of the hand and wrist protector of FIG. 2.
Figure 4:
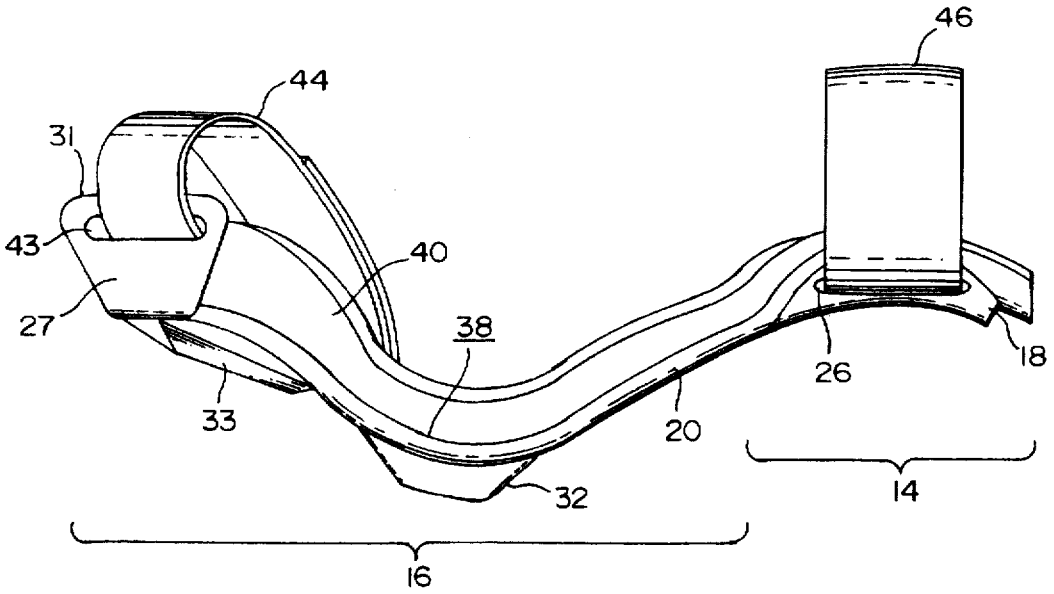
FIG. 4 is a side elevation view of the hand and wrist protector of FIG. 2.
Figure 5:
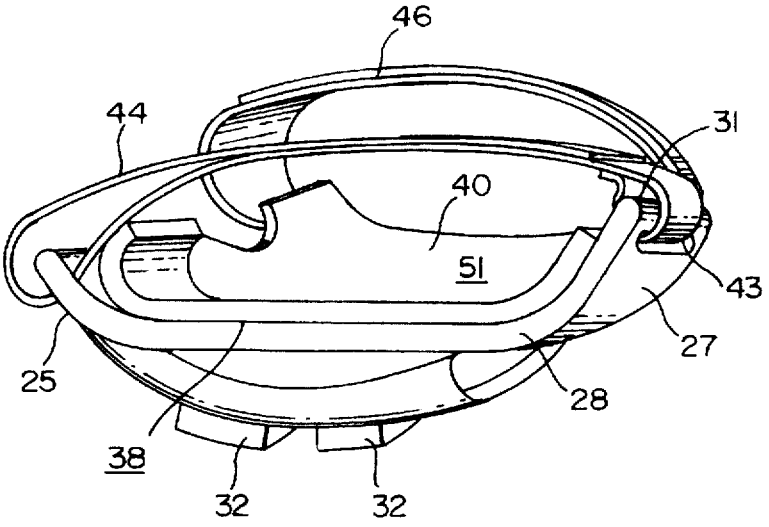
FIG. 5 is an end view of the hand and wrist protector of FIG. 2.

FIGS. 2–5 show the hand and wrist protector 10 of the present invention, with FIGS. 2 and 3 showing the protector most clearly and completely. The hand and wrist protector includes a front portion 12 which in use extends from the inner surface of the lower wrist area over the bottom portion (heel) of the hand and into the palm area. The front portion 12 is made from a rigid plastic material, such as high density polyethylene, approximately ¼-inch thick. Portion 12 is sufficiently rigid that it will bend or twist only slightly when it contacts the ground in a fall of the user, protecting the user's hand and wrist area.

Front portion 12 has a particular configuration which has a number of specific advantages. Front portion 12 basically comprises two sections, a first section 14, which extends from a lower end of front portion 12 over the wrist area of the user, and a second section 16, which extends from section 14 over a large portion of the hand of the user. The first section 14 is very slightly curved from side to side (see FIG. 5) and includes a relatively straight lower end 18 and straight side edges 20 and 22. Lower end 18 is approximately 2¾ inches wide. First section 14 also includes two narrow openings or slots 24 and 26, which extend generally in the longitudinal direction of front portion 12, and are close, respectively, to side edges 20 and 22. These slots permit a lower strap to be positioned therethrough. In the embodiment shown, slots 24 and 26 are approximately 1½ inches long by ¼ or ⅜ inches wide.

Side edges 20 and 22 are straight for approximately 1¼ inches, at which point the edges curve slightly inwardly and then extend straight again for a short distance. Side edge 22 then curves in a semi-circle with a radius of approximately one inch, while side edge 20 curves outwardly and then generally straight rearwardly, extending to upper edge 28 of front portion 12.

Second section 16 initially inclines at a slight angle downwardly (FIG. 4) in elevation from first section 14, so that when the protector is positioned on the user, it fits over the heel portion of the hand. Beyond this point, the second section inclines upwardly, over the palm region of the hand. The left part 25 of section 16 adjacent edge 20 inclines downwardly in elevation, so that it will fit partially around the lower edge of the user's hand between the wrist area and the base of the little finger.

The upper edge 28 of the front portion 12 extends from side edge 20 at a slight angle (approximately 15°–20°) across the hand of the user, so that it remains approximately ½ inch or so below the base of the fingers. At the upper right-hand corner area of the front portion is a part 27 which curves downwardly in elevation, such that it fits partially around the upper edge of the hand, near the base of the first finger. At its widest point, near the free edge 31 thereof, part 27 is approximately one inch wide, while at its narrowest point 29, where it joins the main portion of section 16, it is approximately ½ inch wide. The curvature of the upper end of the protector, particularly parts 25 and 27, is most clearly shown in FIG. 5. An advantage of this particular configuration is that it provides the desired protection for the palm area of the hand and the wrist, but permits full range of finger movement, while also providing some protection for the edge portions of the hand, particularly the lower edge portion.

Attached to or an integral part of front portion 12 are raised skid elements 32—32 and 33. Skid elements 32—32 are located approximately central of second section 16 above the heel portion of the hand when the guard is positioned on the user. The two skid elements shown could be a single, larger element or take the form of a plurality of ridges across the surface of the protector. Skid element 33 is located along upper edge 28 of the hand protector, extending generally across the palm area of the user, under the four fingers. Skid elements 32—32 and 33 are designed to provide a first contact surface for the user during a fall. It is basically extra protection for the user and the protector itself. The skid elements can have different configurations, although generally skid elements 32—32 will cover a significant portion, in the center of the palm, and skid element 33 will be an elongated, narrow section at the upper end of the protector.

Secured to the inner surface 38 of front portion 12 is a cushioned inner pad 40. Inner pad 40 is made from a resilient foam material, typically approximately ⅛-inch thick. Inner pad 40 has an outline which follows generally the outline of the front portion 12, but extends a distance somewhat outwardly from the peripheral edge of front portion 12. Generally, this distance is approximately ¼ inch, except around the base of the thumb area, where the distance is typically ¾ inch. Pad 40 may be attached to the front portion by glue, by staples or rivets or by sewing or any other means.

The remaining parts of the hand protector 10 are two straps 44 and 46. Both of the straps are conventional in structure and configuration. Upper strap 44 is approximately one inch wide. One end of strap 44 is in the form of a loop, attached to the free end (through a narrow slot 43) of the upper right-hand part 27 of the front portion. The other end of strap 44 extends through a similar slot 45, adjacent opposing edge 20, near the top end of the protector. Strap 44 includes Velcro™ fastener segments to provide a convenient means of securing the strap after it has been pulled tight by the user. Strap 46 is similar in construction to strap 44, although it is slightly wider at 1½ inches. It too has a loop at one end which is attached to an edge portion of the first section 14 through slot 24 and then extends from there through slot 26 near the other edge of the first section. Velcro™ fastener segments help secure this strap in place as well, after it has been pulled tight against the wrist by the user.

In use, the two straps 44, 46 are initially loosened and the user fits his hand through them, initially against surface 51 of inner pad 40. The two straps 42 and 44 are then drawn tight against the hand and wrist and end portions of the straps are folded back on the remainder of strap, such that the Velcro fastener patches meet, securing the straps and holding them in place. It is also convenient to remove the protector by loosening the straps and then sliding the protector from the hand.

The above-described invention, with its particular structure and configuration, has a number of advantages. First, the front portion material is quite stiff, so that the front portion bends very little in response to even large forces on it. The thickness, the configuration, and the material all contribute to this rigidity. Front portion 12 is configured to cover the inner wrist of the user and extend up over the heel of the hand and the palm, up to the base of the fingers. It curves around the lower edge of the hand and has a portion which curves around a small section of the hand between the base of the thumb and the forefinger. Such a front portion, in combination with the straps, provides very good protection against wrist and hand sprains as well as fractures and abrasions. The back of the protector (the back of the hand and wrist) can be completely open, so that there is adequate ventilation for the entire hand.

In addition, the configuration and arrangement of the protector at the upper end thereof, in extending across the palm approximately one inch or so below the base of the fingers, permits the user to completely close his/her fist, which is another advantage over existing protective guards. The wrist can be flexed forwardly somewhat, providing a certain amount of mobility, ventilation and comfort. The particular configuration of the protector, with its curvature in two planes, provides good protection for the entire hand without being too bulky or heavy, including protection for the outer edge of the hand. This arrangement, due to the rigidity of the front portion, protects the hand and wrist from being bent backwardly at too great an angle. It thus maintains the wrist in a stable position.

Such a protective guard not only increases the protection for a user relative to previous equipment, but in addition simplifies previous equipment, eliminating completely any back portion of the protector, which was heretofore believed necessary for good protection and required stiffness.

Although a preferred embodiment of the invention has been disclosed for purposes of illustration, it should be understood that various changes, modifications and substitutions may be incorporated in such embodiment without departing from the spirit of the invention, which is defined by the claims which follows:

What is claimed is:

1. A protective member for the hand and wrist area of a user, comprising:

a substantially inflexible front portion extending from a point in the vicinity of the wrist area of the user to an upper palm area of the hand, the front portion contouring over a heel portion of the hand and into the palm area, terminating in an upper end which extends across the palm, slightly below the fingers, the front portion including a first edge part which curves partially about a portion of a first edge of the hand which extends between the thumb and forefinger, and further including an opposite edge part which curves partially around a substantial portion of a second, opposing edge of the hand which extends between the wrist and little finger;

a portion of resilient material attached to an inner surface of the front portion such that it lays adjacent the hand and wrist of the user when the protective member is in place on the user; and a pair of straps, one at an upper end of the front portion, extending between the first and opposite edge parts thereof and the other at an opposing lower end of the front portion, for holding the protective member in place on the hand and wrist of the user.

2. The protective member of claim 1, including raised skid elements positioned on a front surface of said front portion, approximately in the heel area and near the upper end thereof.

3. The protective member of claim 1, characterized by a lack of any stiff protective elements at the rear of the hand area.

4. The protective member of claim 1, wherein the front portion and the pad each comprise a single piece of material.

* * * * *